United States Patent [19]

Holcombe, Jr.

[11] 3,964,181

[45] June 22, 1976

[54] SHOE CONSTRUCTION

[76] Inventor: Cressie E. Holcombe, Jr., 1613 Blackwood Drive, Knoxville, Tenn. 37921

[22] Filed: Feb. 7, 1975

[21] Appl. No.: 548,142

[52] U.S. Cl. ..... 36/91; 36/25 R
[51] Int. Cl.[2] ..... A43B 13/00
[58] Field of Search ..... 36/2.5 R, 25 R, 37

[56] References Cited

UNITED STATES PATENTS

| | | | |
|---|---|---|---|
| 2,212,613 | 8/1940 | Messina | 36/37 X |
| 2,379,000 | 6/1945 | Gould | 36/25 R X |
| 2,555,590 | 6/1951 | Johnson | 36/25 R X |
| 2,814,133 | 11/1957 | Herbst | 36/25 R X |
| 3,300,880 | 1/1967 | Campagna | 36/2.5 R |
| 3,305,947 | 2/1967 | Kalsoy | 36/2.5 R |
| 3,613,272 | 10/1971 | Fukuoka | 36/2.5 R |

*Primary Examiner*—Alfred R. Guest
*Attorney, Agent, or Firm*—Martin J. Skinner

[57] ABSTRACT

A shoe construction is described for improving the posture of the wearer, as well as reducing the wear on the rearward edge of the heel, without substantially changing the exterior appearance from conventional shoes. This is accomplished by hollowing out a portion of the top of the sole portion, particularly in the heel region, so that the sole of the wearer is inclined upwardly toward the toe portion of the sole at an angle of about 2°–10°. The shoe upper is substantially conventional; however, to comfortably accommodate the ankle of the wearer, due to the lowered heel, the rearward edge of the shoe upper is lowered an equivalent amount. The development is illustrated for shoes having a separate heel portion as well as for wedge-type shoes.

5 Claims, 5 Drawing Figures

SHOE CONSTRUCTION

BACKGROUND OF THE INVENTION

My invention relates generally to shoe construction for human wearers and more particularly to a shoe construction for improving posture of the wearer.

Overall shoe styles vary substantially from year to year depending to a large degree, on fads begun by fashion designers. For a while most shoes are very fancy, then later the style is to be very plain. The toes may be pointed, or blunt and broad, and the heels may be high or low. One rather common characteristic, however, is that the sole of most shoes is generally parallel with the walking surface in the region of the ball and toes of the foot, and that the rearward portion of the sole is elevated by a heel. The sole element is substantially the same thickness throughout its length in such "conventional" designs. This construction, in most instances, maintains the wearer's heel elevated above the ball of the foot during standing or walking. This is in contrast to the position of the heel and ball during bare foot standing and walking.

Recently an effort has been made to modify shoe construction to improve posture by supporting the foot in a more natural position, i.e., as if no shoe was present. Foremost in this change is the construction described and claimed in U.S. Pat. No. 3,305,947 to Anne S. J. Kalsoy. This is widely marketed as the "Earth Shoe" and has been imitated by many manufacturers. The major drawback is the appearance because of the exterior style of the "Earth Shoe", and its competitors, departs substantially from the conventional design and is useful only for casual or informal wear. In addition, the complex shape of the sole surface in contact with the foot creates manufacturing and fitting problems for the various sizes in both women's and men's shoes.

SUMMARY OF THE INVENTION

My shoe construction improves posture through the use of an upwardly inclined surface for the sole of the foot so that the ball of the foot as well as the toes are slightly elevated above the heel, the angle of inclination being about 2–10° with a preferred angle of about 5°. This is accomplished without substantial change in the exterior appearance of the shoe by hollowing out the shoe heel to accommodate the heel of the foot and by raising the inner shoe sole surface in the toe region, with a gradual transition therebetween.

DETAILED DESCRIPTION

My improved shoe construction is described hereinafter in the form of a strap-and-buckle style for men. The construction, however, is not limited to that style and is equally applicable to women's shoes except for spike heel styles.

Figure 1:
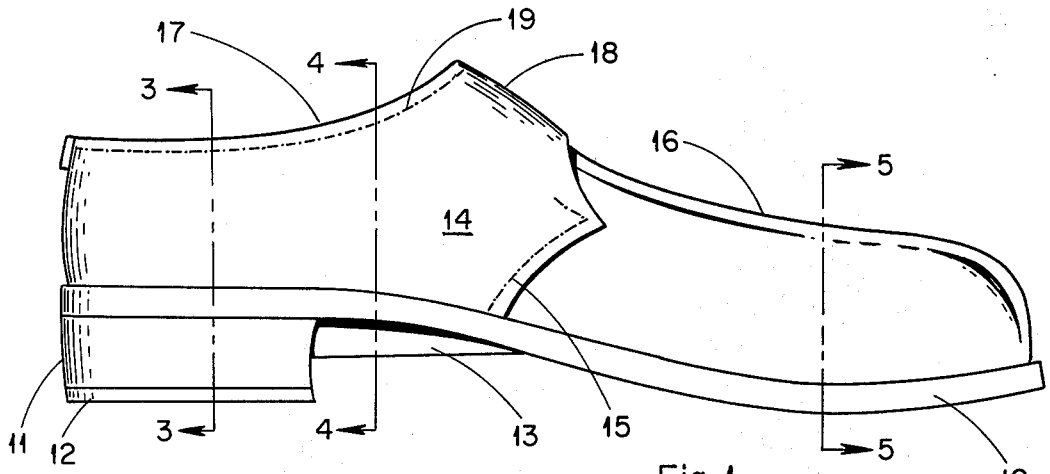
FIG. 1 is an elevation, from the instep side, of a shoe constructed according to my invention.

The exterior of my shoe is illustrated in FIG. 1 as viewed from the instep side. It will be apparent that the shoe exterior is of conventional appearance with a sole 10 extending its full length. A heel 11 is depending from the rear of the sole 10, and the forward portion of the sole 10 is substantially flat forming a tread plane with the bottom of the heel. The bottom of the heel 11 may be provided with a replaceable lift 12. A bridge 13, the purpose of which will be described below, is provided forward of the heel 11 in the shank of the shoe. This bridge 13 may be V-shaped or generally rounded on the exterior. A shoe upper 14 is attached by conventional means near the periphery of the sole 10. This upper 14 may be formed of two pieces, joined as by stitching 15, whereby the toe portion or vamp 16 is closed over the forward portion of the foot and the rearward portion forms a throat 17 to provide for insertion of a foot into the shoe. This rear portion also is formed into a strap 18 that passes over the foot instep to join a buckle (not shown) on the opposite side. The line 19 designates stitching along the edge of the throat 17.

Figure 2:
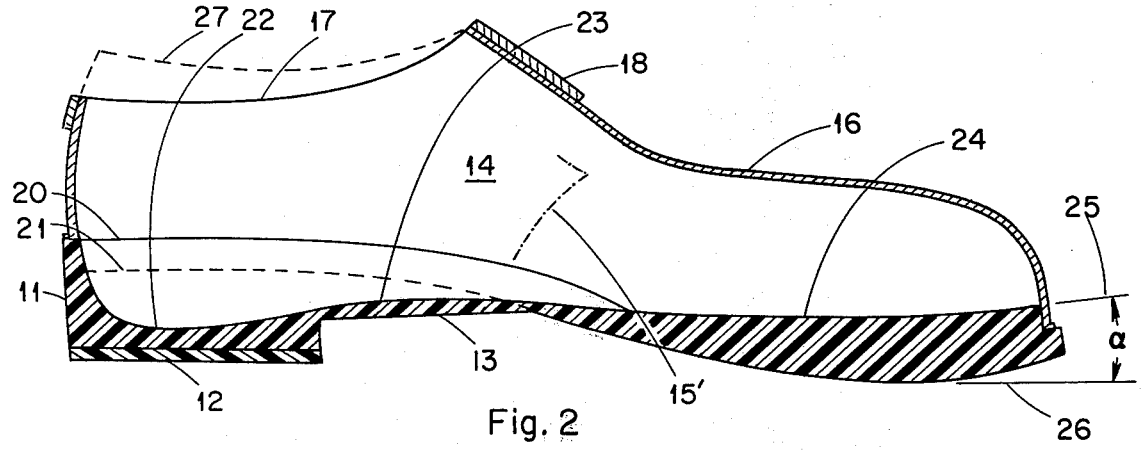
FIG. 2 is a vertical section of the shoe of FIG. 1 along its length.

The interior of my shoe, which accounts for its primary features, is shown in cross section in FIG. 2. Line 20 therein is the top of the shoe sole 10 at its periphery, and dashed line 21 shows the apparent location of the bottom of the shoe sole based on the exterior of the shoe (FIG. 1). By comparing this with FIG. 1, it may be seen that the heel 11 is provided with a depression 22 so that the heel of a wearer is lowered substantially. Similarly, a second depression 23 is provided on the upper surface of the bridge 13 and smoothly joins the heel depression 22. Furthermore, the upper surface of the sole 10 has a raised platform 24 in the region of the ball of the foot and the toes. The upper surface of this platform 24 is a gradual transition from depression 23. Line 15' is the interior of stitching joining portions of the upper 14.

The total upper contour of the sole is such that a line 25 drawn from the highest point of the platform 24 at the extreme toe portion to the heel depression 22 forms an angle, $\alpha$ to a line 26 which is equivalent to a flat walking surface. The size of the angle $\alpha$ is determined by the size of the depressions 22, 23 and the platform 24 and may be, for example, 2°–10°. An angle of about 5° is preferred to accomplish improved posture and comfort. To achieve the higher values of $\alpha$, the apparent thickness of the sole 10, as viewed from the exterior, would be increased compared to the thickness illustrated in these figures.

Also shown in this FIG. 2 is the preferred lowering of the rearward edge (the counter) of the throat 17. Dashed line 27 indicates the level of this edge in a conventional shoe. This modification eliminates undue chaffing of the ankle of a wearer when the heel of the foot is below a conventional level.

Figure 3:
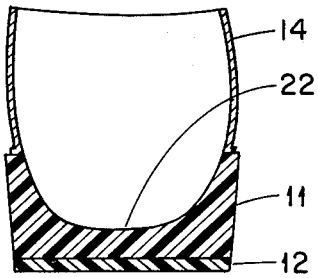
FIG. 3 is a vertical section of the shoe of FIG. 1 taken at 3—3 thereof.
Figure 4:
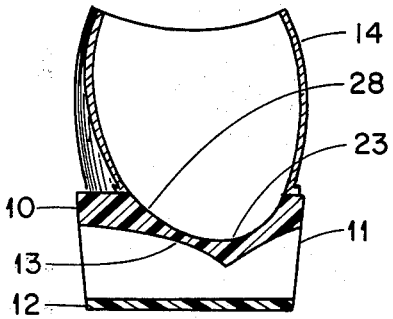
FIG. 4 is a vertical section of the shoe of FIG. 1 taken at 4—4 thereof.
Figure 5:
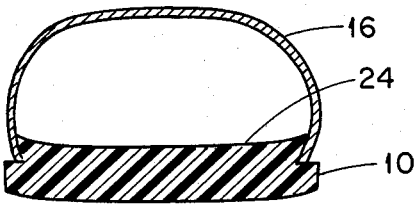
FIG. 5 is a vertical section of the shoe of FIG. 1 taken at 5—5 thereof.

Transverse cross sections of my shoe are illustrated typically in FIGS. 3–5. In FIG. 3, for example, it may be seen that the depression 22 in the heel 11 is symmetrical conforming in general to the heel of a wearer. The cross section shown in FIG. 4 is taken through the shank region of the shoe where the depression 23 is nonsymmetrical to provide a longitudinal arch support 28. For this reason, the bridge 13 may be positioned away from the inner edge of the sole 10, as shown. The contour of the platform 24 is shown in FIG. 5. It may be seen that the top surface thereof is substantially flat and parallel to a walking surface, across the shoe, to support the ball and toes of a wearer's foot. The vamp 16 of the shoe upper 14 is raised higher than that of a conventional shoe to provide adequate toe room above the platform 24.

Although not shown in the figures, my shoe construction would include several features found in conventional shoes. For example, a preferred construction would include a lining and/or an insole for ease of foot movement into the shoe and general comfort during wear. Also, if desired, a stiffening element may be inserted in the shank for additional arch support. Instead of the simple stitching 19 at the edge of the throat 17, a collar may be added for styling, etc. Thus, it may be seen that my shoe construction is amenable to all design and construction features of conventional shoes with the added unique feature of the lowered interior of the heel and the raised toe region to place the bottom of the foot on an upwardly inclined plane toward the toes. My shoe construction thus is useful for wedge-style shoes and, for such, a separate bridge 13 is not required as the continuous sole of such style provides the equivalent structure.

My shoe construction may be achieved using fabrication methods already known in the art. The contour of the upper surface of the sole unit 10 is accomplished readily with a molding of Neoprene rubber, plasticized polyvinyl chloride, ethylene/ethyl acrylate copolymer Bakelite DPDA-2304, Union Carbide), or similar man-made materials conventionally used for shoe soles. This molding would include the heel 11, the bridge 13 and could include the platform 24. Similarly, the lift 12 may be part of the heel 11; however, if separate, it may be replaced when sufficiently worn. Alternatively, the sole unit may be built up of multiple layers of material. If desired, an exterior layer of leather may be added to the lower sole surface in contact with the ground. Also, if of value for the quality of the shoe, an insole of leather may be added to the top surface of the sole 10. The upper may be fabricated from either leather or man-made materials and, after assembly into a desired style, attached to the sole about the periphery as by sewing or gluing. A welt-type construction may be used, if desired.

Thus, it may be seen that I have provided for a shoe having external appearance closely approximating most conventional casual or formal shoe styles for men or women, e.g., wing tip, moccasin toe, broque, wedge, etc., with an interior design to provide an "up hill" stance to the sole of the foot. This position of the foot gives rise to a more erect posture of the individual wearer. In addition, the weight of the individual is spread over a greater area of the heel (or lift) during the walking process and less edge wear will occur; thus, the lift will not require replacement as frequently.

While the foregoing describes my invention in a specific form, it will be understood that certain modifications of the elements may be made without departing from the invention as claimed.

I claim:

1. A shoe construction for improving the posture of a wearer, which comprises:

a sole member having a top surface with an exposed perpiheral edge of substantially uniform thickness, the peripheral edge being more elevated at a heel portion of the sole than at a toe portion;

a heel integrally formed with the sole and depending therefrom at the heel portion to form a tread plane with the sole at the toe portion;

a bridge integrally formed with the heel and sole extending forwardly from the heel in a shank portion of the sole;

a shoe upper secured to the top surface of the sole at substantially the peripheral edge; and wherein the top surface of the sole is provided with a longitudinal depression extending downwardly into the heel and forwardly into the bridge to a depth sufficient to create a foot-supporting surface inclined continously upwardly from the depression in the heel to a most forwardly position of the toe portion of the sole, said surface being planar in the forepart.

2. The shoe construction of claim 1 wherein the bridge decreases in transverse width at increased distances from the shank of the sole and depends substantially toward the tread plane.

3. The shoe construction of claim 1 wherein the depression, in a transverse direction, is substantially symmetrical in the heel to conform to a wearer's heel, and is non-symmetrical in the bridge to provide a longitudinal arch support for a wearer's foot in an instep portion of the shank of the sole.

4. The shoe construction of claim 1 wherein the shoe upper is provided with a counter having a height reduced an amount equivalent to the depth of the depression in the heel.

5. The shoe construction of claim 1 further comprising a platform integrally formed on the top surface of the sole in the toe portion within the shoe upper, the platform having an upwardly tapered upper surface in a longitudinal direction, the tapered surface being an angular extension of the depression in the heel and bridge to form the upwardly inclined foot-supporting surface.

* * * * *